US011743652B2

(12) United States Patent
Stojanovic et al.

(10) Patent No.: US 11,743,652 B2
(45) Date of Patent: Aug. 29, 2023

(54) SENSORS WITH CORRUGATED DIAPHRAGMS

(71) Applicant: ams AG, Premstaetten (AT)

(72) Inventors: Goran Stojanovic, Eindhoven (NL); Colin Steele, Eindhoven (NL); Simon Mueller, Eindhoven (NL); Thomas Froehlich, Eindhoven (NL)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 17/287,455

(22) PCT Filed: Oct. 18, 2019

(86) PCT No.: PCT/EP2019/078460
§ 371 (c)(1),
(2) Date: Apr. 21, 2021

(87) PCT Pub. No.: WO2020/083791
PCT Pub. Date: Apr. 30, 2020

(65) Prior Publication Data

US 2021/0392438 A1 Dec. 16, 2021

Related U.S. Application Data

(60) Provisional application No. 62/749,351, filed on Oct. 23, 2018.

(51) Int. Cl.
*H04R 7/14* (2006.01)

(52) U.S. Cl.
CPC ..... *H04R 7/14* (2013.01)

(58) Field of Classification Search
CPC ..... H04R 7/14; H04R 19/005
See application file for complete search history.

(56) References Cited

U.S. PATENT DOCUMENTS

| | | | | |
|---|---|---|---|---|
| 4,241,325 | A | 12/1980 | Di Giovanni | |
| 9,936,298 | B2 * | 4/2018 | Buck | H04R 7/14 |
| 10,779,100 | B2 * | 9/2020 | Peng | B81C 1/00158 |
| 2005/0238188 | A1 * | 10/2005 | Wilcox | H04R 23/008 381/172 |
| 2006/0081057 | A1 | 4/2006 | Silverbrook et al. | |
| 2006/0141658 | A1 | 6/2006 | Bar-Sadeh et al. | |
| 2006/0181712 | A1 | 8/2006 | Degertekin et al. | |
| 2007/0165896 | A1 | 7/2007 | Miles et al. | |
| 2010/0207484 | A1 | 8/2010 | Chang | |

OTHER PUBLICATIONS

Bahmanyar, M.R., UK Patent Application GB 2571141 A, Aug. 21, 2019 (Year: 2019).*

AMS AG, "Sensors With Corrugated Diaphragms", dated Jun. 22, 2023, Second Chinese Office Action, CN application No. 201980070210.9, pp. 1-8.

* cited by examiner

*Primary Examiner* — Brian Ensey
(74) *Attorney, Agent, or Firm* — Tarolli, Sundheim, Covell & Tummino LLP

(57) ABSTRACT

A sensor includes a substrate; and a corrugated diaphragm offset from the substrate. The corrugated diaphragm is configured to deflect responsive to a sound wave impinging on the corrugated diaphragm. A cavity is defined between the corrugated diaphragm and the substrate, the corrugated diaphragm forming a top surface of the cavity and the substrate forming a bottom surface of the cavity. A pressure in the cavity is lower than a pressure outside of the cavity.

22 Claims, 9 Drawing Sheets

SENSORS WITH CORRUGATED DIAPHRAGMS

RELATED APPLICATIONS

The present invention is a U.S. National Stage under 35 USC 371 patent application, claiming priority to Serial No. PCT/EP2019/078460, filed on 18 Oct. 2019; which claims priority of U.S. Provisional Application Ser. No. 62/749,351, filed on 23 Oct. 2018, the entirety of both of which are incorporated herein by reference.

BACKGROUND

In a pressure sensor, such as a microphone or a pressure transducer, a pressure (e.g., sound waves) applied to a detection structure of the sensor causes deflection of a flexible diaphragm. The deflection of the diaphragm can be detected by a change in a capacitance of the deflection structure or can be detected using optical methods. The detected deflection can be converted to an output signal, such as a voltage signal.

SUMMARY

In an aspect, a sensor includes a substrate; and a corrugated diaphragm offset from the substrate. The corrugated diaphragm is configured to deflect responsive to a sound wave impinging on the corrugated diaphragm. A cavity is defined between the corrugated diaphragm and the substrate, the corrugated diaphragm forming a top surface of the cavity and the substrate forming a bottom surface of the cavity. A pressure in the cavity is lower than a pressure outside of the cavity.

Embodiments can include one or more of the following features.

The corrugated diaphragm includes a membrane.

The corrugated diaphragm includes a plate.

The sensor includes circuitry configured to enable generation of an electrical signal based on the deflection of the corrugated diaphragm.

The corrugated diaphragm includes a conductive diaphragm. The substrate includes an electrode. The sensor includes circuitry configured to enable generation of an electrical signal based on a voltage between the corrugated diaphragm and the electrode of the substrate. The sensor includes a voltage source configured to apply a bias voltage between the diaphragm and the electrode of the substrate.

A surface of the corrugated diaphragm facing the substrate is reflective. The substrate includes a light source positioned to illuminate the reflective surface of the corrugated diaphragm; and a detector configured to generate an electrical signal based on light reflected from the reflective surface of the corrugated diaphragm.

The thickness of the corrugated diaphragm is between 0.1 μm and 1 μm.

A height of the cavity between the substrate and the corrugated diaphragm is between 10 nm and 10 μm, e.g., between 50 nm and 1 μm.

The cavity is hermetically sealed.

The cavity is at near-vacuum pressure.

The corrugated diaphragm exhibits a substantially linear relationship between applied pressure and deflection.

A residual stress in the corrugated diaphragm is between 1 MPa and 1 GPa.

A resonant frequency of the corrugated diaphragm is an audio frequency range.

The corrugated diaphragm has a corrugation profile factor of between 1 and 24.

The corrugated diaphragm includes multiple concentric corrugations.

The corrugated diaphragm includes a corrugation centered around a center of the membrane.

The sensor includes a microphone.

The sensor includes a transducer.

The sensor includes a pressure sensor.

In an aspect, a method includes deflecting a corrugated diaphragm of a sensor into a cavity responsive to a sound wave impinging on the corrugated diaphragm. A top surface of the cavity is defined by the corrugated diaphragm and a bottom surface of the cavity is defined by a substrate of the sensor. A pressure in the cavity is lower than a pressure outside the cavity. The method includes generating an electrical signal based on the deflection of the corrugated diaphragm.

Embodiments can include one or more of the following features.

Generating an electrical signal based on the deflection of the corrugated diaphragm includes generating an electrical signal based on a voltage between the corrugated diaphragm and an electrode of the substrate.

Generating an electrical signal based on the deflection of the corrugated diaphragm includes illuminating a reflective surface of the corrugated diaphragm; and generating an electrical signal based on light reflected from the reflective surface of the corrugated diaphragm.

In an aspect, a method for making a sensor includes forming a corrugated diaphragm offset from a substrate, a thickness of the corrugated diaphragm being sufficient for the corrugated diaphragm to deflect responsive to a sound wave impinging on the corrugated diaphragm; and defining a cavity between the corrugated diaphragm and the substrate, the corrugated diaphragm forming a top surface of the cavity and the substrate forming a bottom surface of the cavity, in which the cavity is hermetically sealed.

Embodiments can include one or more of the following features.

The method includes forming an electrode on the substrate. The method includes coupling the corrugated diaphragm and the electrode on the substrate to an electrical circuit.

The method includes forming a light source and a photodetector on the substrate.

Forming a corrugated diaphragm includes forming the corrugated diaphragm by a complementary metal-oxide-semiconductor (CMOS) fabrication process. Defining a cavity between the corrugated diaphragm and the substrate includes removing an insulating layer disposed between the corrugated diaphragm and the substrate by an etching process.

Forming a corrugated diaphragm includes forming the corrugated diaphragm by a microelectromechanical systems (MEMS) fabrication process.

Forming a corrugated diaphragm includes forming a corrugated diaphragm having a thickness of between 0.1 μm and 1 μm.

Defining a cavity between the corrugated diaphragm and the substrate includes forming a cavity having a height of between 1 nm and 10 μm, e.g., between 50 nm and 1 μm.

Forming a corrugated diaphragm includes forming a diaphragm having multiple concentric corrugations.

Forming a corrugated diaphragm includes forming a diaphragm having a corrugation centered around a center of the diaphragm.

The approaches described here can have one or more of the following advantages. Sensors, such as microphones, with a near-vacuum back cavity, can have a high signal-to-noise ratio and a high sensitivity to low intensity pressure fluctuations, such as low intensity sound. The start-up time and response time of the sensors can be nearly immediate. The sensors can be robust against contaminants and against fluctuations in environmental conditions such as temperature or humidity. The sensors can be fabricated using well established, inexpensive processing, such as complementary metal oxide semiconductor (CMOS) processing, and the processing can enable a high level of control over the geometry of the diaphragms and hence over the performance of the sensors. The sensors can be relatively compact, with a small height back volume, and can be functional without external packaging.

DETAILED DESCRIPTION

We describe here sensors, such as microphones, that have high signal-to-noise ratios and high sensitivity to small pressure fluctuations. The sensors can include a corrugated diaphragm that deflects toward a substrate responsive to an applied pressure, such as sound. A cavity between the diaphragm and the substrate is sealed and can be at near-vacuum pressure, enabling the diaphragm to be responsive to small variations in applied pressure. The diaphragm is corrugated, which enables the diaphragm to withstand the large pressure differential between the exterior and the near-vacuum pressure in the cavity, reduces residual stress on the diaphragm, and enhances the mechanical sensitivity and linearity of the diaphragm.

Figure 1:
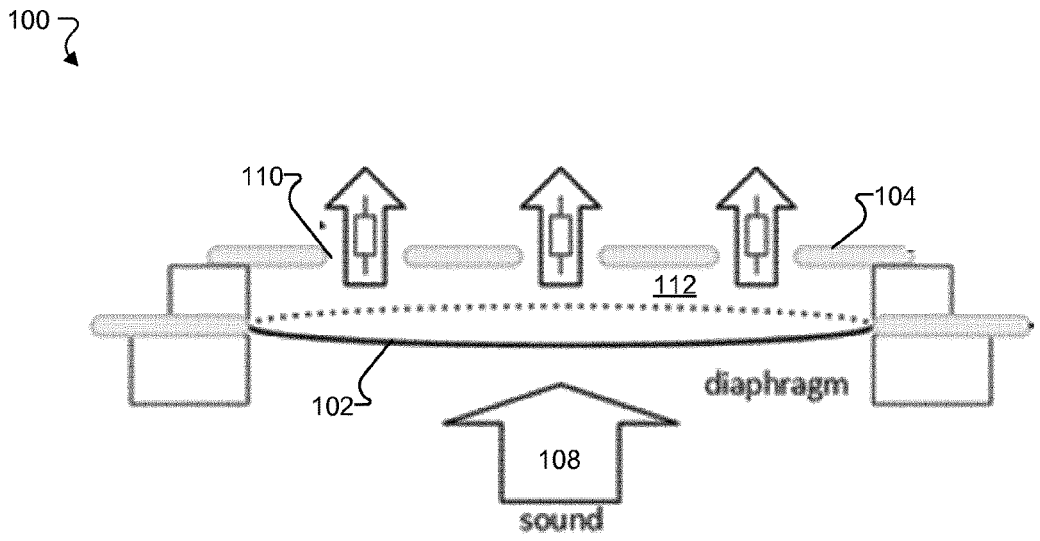
FIGS. 1 and 2 are diagrams of sensors.

Referring to FIG. 1, an example microphone 100 includes a diaphragm 102 separated from a back plate 104 by side walls 106. Acoustic pressure (e.g., sound) 108 impinges on the diaphragm 102, causing the diaphragm 102 to deflect towards the back plate 104. The deflection of the diaphragm 102 is detected, e.g., by capacitive or optical detection, and converted into an output voltage signal by circuitry. Holes 110 can be formed in the back plate 104 (as shown), one or more of the side walls 106, or both to release pressure from a cavity 112 defined between the diaphragm 102 and the back plate 104. The holes 110 can allow for air flow through the microphone, presenting acoustic resistance and giving rise to acoustic noise in the voltage signal produced from the microphone 100.

Figure 2:
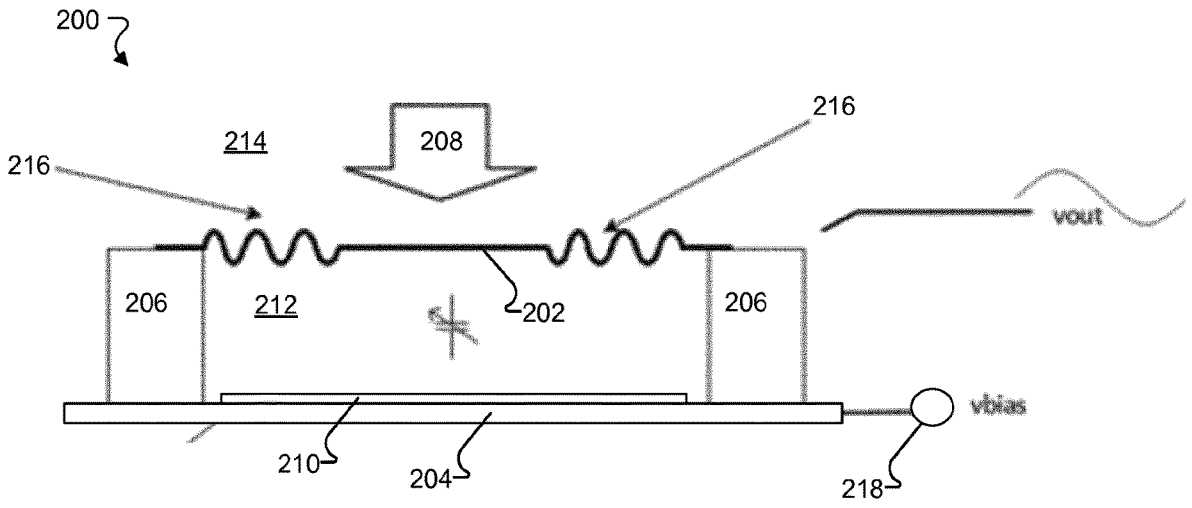

FIG. 2 shows an example of a low-noise capacitive microphone 200. Although we describe FIG. 2 in the context of microphone, a similar structure can also be used for other types of capacitive sensors, such as other types of audio sensors, pressure sensors, transducers (e.g., a capacitive micromachined ultrasonic transducer (CMUT)), or other sensors. For instance, the sensor can be a transducer capable of detecting atmospheric pressure changes.

The low-noise microphone 200 includes a diaphragm 202 separated from a substrate 204 by side walls 206. A membrane is a structure that, when deflected, experiences a restoring force created from tension in the membrane itself. A plate is a structure that, when deflected, experiences a restoring force arising from elastic properties, such as the Young's modulus, of the material.

Figure 8:
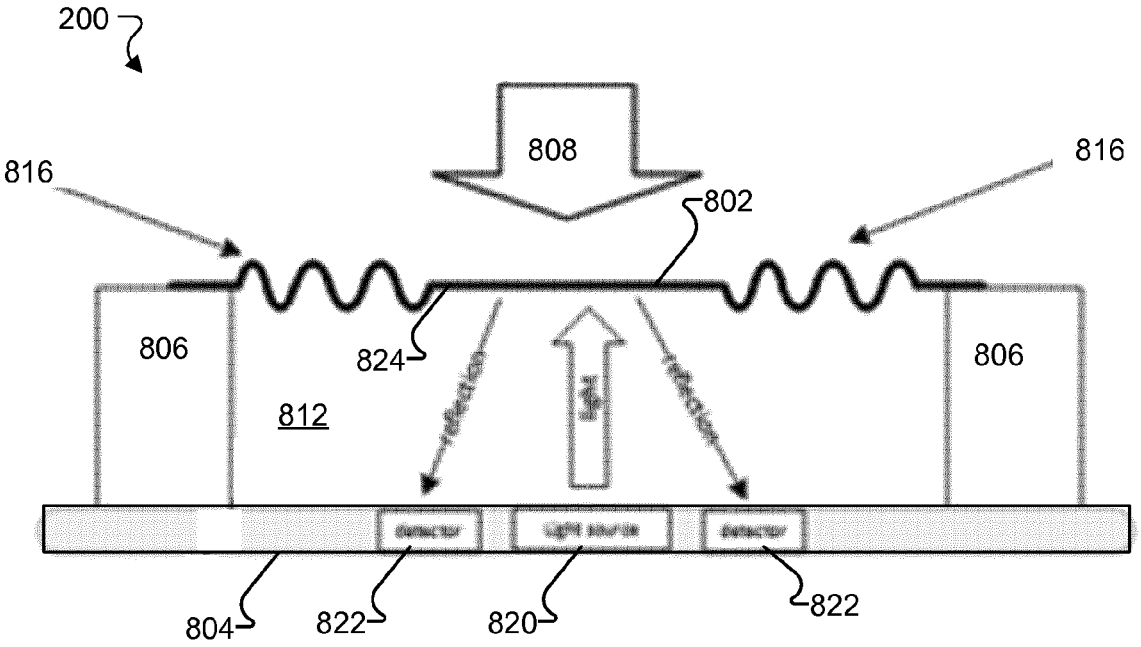
FIG. 8 is a diagram of a sensor.

In the capacitive microphone 200 of FIG. 2, the diaphragm 202 can be formed of a conductive material, such as a metal, e.g., aluminum or tungsten; a conductive polymer; conductive polycrystalline silicon; or other conductive material. In some examples, the diaphragm 202 can be formed of a non-conductive material, such as silicon nitride, silicon oxide, or a non-conductive polymer, with a conductive layer formed thereon. The substrate 204 can be made of a conductive material or can include a conductive electrode 210 formed on the surface of the substrate 204 or integrally with the substrate. For instance, the substrate 204 can be an integrated circuit, such as an ASIC (Application-Specific Integrated Circuit) chip, with a thin metal film formed on its surface that acts as the electrode 210. Diaphragms in other types of microphones, such as the microphone 800 of FIG. 8, are not necessarily formed of a conductive material.

Sound detection by the microphone 200 is based on a capacitance between the conductive diaphragm 202 and the conductive electrode 210. When a sound wave 202 is incident on the diaphragm 202, the acoustic pressure from the sound causes the diaphragm 202 to deflect towards the substrate 204. The deflection of the diaphragm 202 changes the capacitance between the conductive diaphragm 202 and the conductive electrode 210 on the substrate 204, and causing a change in a voltage signal $V_{out}$ output from the microphone 200. In this way, the output voltage signal $V_{out}$ represents the sound wave incident on the diaphragm 202. For instance, the microphone can include circuitry that generates a signal based on the output voltage signal $V_{out}$, e.g., proportional to the output voltage signal.

The diaphragm 202, substrate 204, and side walls 206 are solid materials with no through-thickness holes. These solid materials define an interior cavity 212 that is isolated from an exterior 214 of the microphone 200. For instance, the cavity 212 can be hermetically sealed. With no through-thickness holes in the diaphragm 202, the substrate 204, and the side walls 206, there are few sources of acoustic noise in the microphone 200, meaning that there is little noise in the voltage signal $V_{out}$ output from the microphone 200. As a result, a high signal-to-noise ratio can be achieved. Furthermore, the sealed cavity 212 enables the microphone 200 to be operable with or without external packaging.

In some examples, the pressure in the cavity 212 (referred to as the cavity pressure Pc) can be lower than the pressure at the exterior 214 of the microphone (referred to as the exterior pressure PE), e.g., below atmospheric pressure. For instance, the cavity pressure can be between about 10 kPa and about 1 μPa, a range we sometimes refer to as "near-vacuum," e.g., about 10 kPa, about 1 kPa, about 100 Pa, about 10 Pa, about 1 Pa, about 100 mPa, about 10 mPa, about 1 mPa, about 100 μPa, about 10 μPa, or about 1 μPa. In some examples, a bias voltage Vbias can be applied between the diaphragm 202 and the conductive electrode 210 (as shown in FIG. 2) by a voltage source 218 to help the diaphragm 202 sustain the large pressure differential between the exterior pressure and the cavity pressure.

A sealed cavity 212 is robust against contaminants, such as dust or moisture, improving the reliability of the microphone 200. With a sealed, near-vacuum cavity, environmental factors such as temperature or humidity can have little to no impact on the operation of the microphone 200, rendering the response of the microphone 200 stable and consistent over a wide range of operating conditions.

A sealed cavity 212 enables the microphone 200 to exhibit a faster start-up time and response time than a microphone with an air-filled cavity (e.g., the microphone 100 of FIG. 1). In a microphone with an air-filled cavity, an acoustic circuit includes resistive elements (e.g., holes in the diaphragm or back volume) and capacitive elements (e.g., the structure formed by the diaphragm and the back plate). These resistive and capacitive elements together act as a filter with an associated time constant, which can be on the order of tens of milliseconds. For each change in atmospheric pressure, the microphone response stabilizes on a time scale of that time constant, which can contribute to slow start-up time or to a lag in responsiveness to rapidly changing signals. In the microphone 200, there are no resistive elements (e.g., no holes in the sealed cavity 212), and accordingly the microphone has no associated time constant. The response time of the microphone is nearly immediate.

The near-vacuum cavity pressure allows the height h of the cavity to be relatively small while still enabling capacitive detection, meaning that the microphone 200 can be a compact, low-profile device. For instance, the height of the cavity can be between about 10 nm and about 10 μm, e.g., between about 50 nm and about 1 μm, between about 100 nm and about 1 μm, between about 50 nm and 500 nm, or between about 100 nm and about 500 nm. In some examples, the height of the cavity can be greater than about 10 μm.

The diaphragm 202 can be a thin diaphragm, e.g., with a thickness of between about 0.1 μm and about 1 μm, e.g., about 0.1 μm, about 0.2 μm, about 0.4 μm, about 0.5 μm, about 0.6 μm, about 0.8 μm, or about 0.1 μm. A thin diaphragm 202 can undergo a larger displacement responsive to small pressure variations, e.g., from low intensity sound, than a thicker diaphragm. A thin diaphragm is accordingly more sensitive, e.g., to low intensity sound, than a thicker diaphragm.

The diaphragm 202 can be a corrugated diaphragm that includes one or more corrugations 216. The corrugations 216 improve the linearity of the diaphragm displacement due to the large static pressure differential between the exterior pressure PE (e.g., atmospheric pressure, such as approximately 100 kPa) and the near-vacuum cavity pressure Pc. The corrugations 216 also release residual stress in the diaphragm 202, enhancing the sensitivity of the diaphragm 202.

The corrugations of the corrugated diaphragm 202 can have any of a variety of configurations. For instance, the corrugated diaphragm 202 can have one or more concentric corrugations, e.g., centered substantially around the center of the membrane. The corrugations can be circular, oval, hexagonal, octagonal, or other shapes. In some examples, the shape of the corrugations can correspond to the shape of the diaphragm; in some examples, the corrugations can have a shape that is different from the shape of the diaphragm. The corrugations can have smooth cross-sectional profiles (e.g., substantially sinusoidal profiles) or stepped profiles. In some examples, the profile of the corrugations can vary at different points on the diaphragm, e.g., the profile of the corrugations can vary between the edge of the diaphragm and the center of the diaphragm.

Figure 3A:
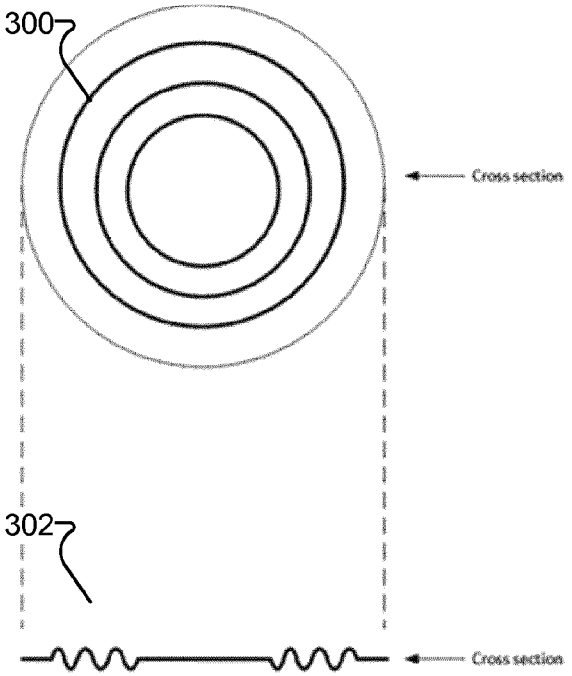
FIGS. 3A-3D are diagrams of example corrugation configurations.
Figure 3C:
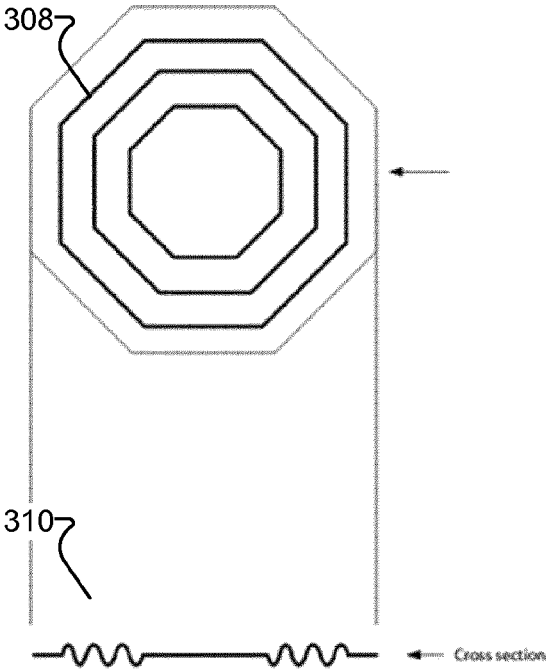
Figure 3B:
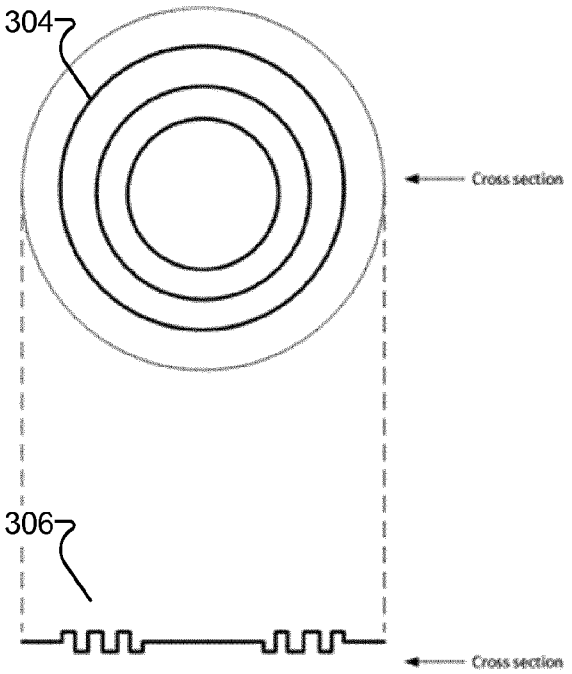
Figure 3D:
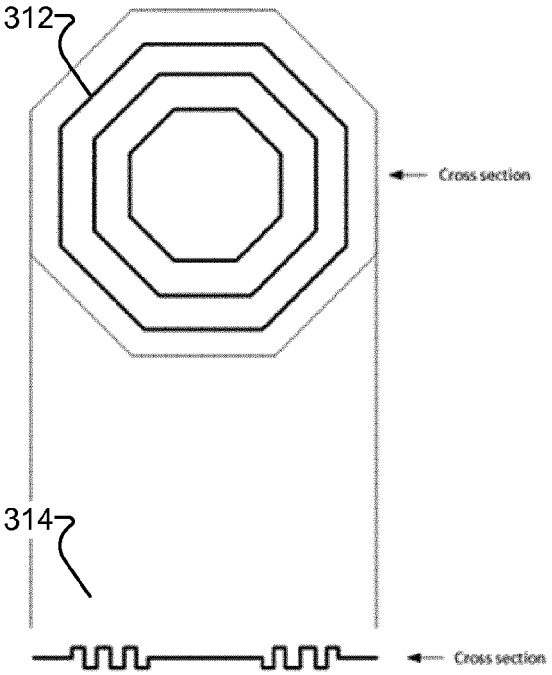

Example corrugation configurations are shown in FIGS. 3A-3D. Referring to FIG. 3A, some example corrugations 300 can be substantially circular corrugations in a substantially circular diaphragm, and can have a smooth, substantially sinusoidal profile 302. Referring to FIG. 3B, some example corrugations 304 can be substantially circular corrugations in a substantially circular diaphragm, and can have a stepped profile 306. Referring to FIG. 3C, some example corrugations 308 can be substantially octagonal corrugations in a substantially octagonal diaphragm, and can have a smooth, substantially sinusoidal profile 310. Referring to FIG. 3D, some example corrugations 312 can be substantially octagonal corrugations in a substantially octagonal diaphragm, and can have a stepped profile 314.

The corrugation of a surface, such as the diaphragm 202, can be characterized by a corrugation profile factor q. The corrugation profile factor of a diaphragm is based on geometric features of the diaphragm, such as the corrugation depth H, the corrugation arc length s, the spatial period l of the corrugations, and the thickness of the diaphragm h. In a specific example, the corrugation profile factor of a circular diaphragm with sinusoidal corrugations is given by Equation (1):

$$q^2 = \frac{s}{l}\left(1 + 1.5\left(\frac{H}{h}\right)^2\right). \tag{1}$$

A surface with a corrugation profile factor of 1 is a surface with no corrugations (i.e., a flat surface). A higher corrugation profile factor indicates a more corrugated surface. In some examples, the diaphragm 202 can have a corrugation profile factor between 1 and 24, e.g., between 5 and 15. In some examples, the corrugation profile factor of the diaphragm can vary at different points on the diaphragm.

The presence of corrugations can reduce residual stress in the diaphragm 202, such as residual stress resulting from the fabrication of the diaphragm. A reduction in residual stress can improve the reliability of the diaphragm 202. Controlling residual stress in a deposited film or plate through fabrication parameters can be challenging. By controlling the stress through geometric factors such as corrugations, the residual stress can be controlled precisely and accurate. In some examples, the corrugations can reduce the residual stress in a diaphragm by a factor of at least 10, e.g., at least 20, at least 50, or at least 100.

In a specific example, the equilibrium stress $\sigma_e$ of a corrugated membrane is given by Equation (2):

$$\sigma_e = \eta\sigma_0,$$

where $\sigma_0$ is the residual stress in a diaphragm without corrugations and $\eta$ is a stress attenuation coefficient, where $\eta$ is less than 1. As the corrugation profile factor q of the diaphragm increases, $\eta$ decreases and the equilibrium stress $\sigma_e$ of the corrugated membrane decreases. For instance, the residual stress can be in a range of between about 1 MPa and about 1 GPa and $\eta$ can have a value of less than about 0.1, e.g., about 0.05 or about 0.01.

The corrugation profile factor of the diaphragm 202 also affects the relationship between applied pressure (e.g., sound) and deflection of the diaphragm 202. The pressure-deflection relationship for a clamped, circular diaphragm can be given by Equation (3):

$$P = a\frac{w}{h} + b\left(\frac{w}{h}\right)^3, \tag{3}$$

where P is the applied pressure, w is the deflection at the center of the diaphragm, and h is the thickness of the diaphragm. The pressure-deflection relationship has a first, linear component and a second, non-linear component. As the corrugation profile factor q of the diaphragm increases, the coefficient a of the linear component increases and the coefficient b of the non-linear component decreases.

As can be seen from Equation (3), for small deflections, a corrugated diaphragm is stiffer than an otherwise similar, but non-corrugated, diaphragm. By small deflection, we mean a deflection that is small compared to the thickness of the diaphragm, e.g., a deflection that is less than about 30% of the thickness of the diaphragm, e.g., less than about 25%, less than about 20%, or less than about 15% of the thickness of the diaphragm. This means that for small deflections, it takes more pressure to deflect a corrugated membrane to a given deflection than to deflect an otherwise similar, but non-corrugated, diaphragm by the same amount. For larger deflections, the corrugated diaphragm becomes less stiff than the non-corrugated diaphragm. By large deflection, we mean a deflection that is large compared to the thickness of the diaphragm, e.g., a deflection that is at least 2 times the thickness of the diaphragm, e.g., at least 3 times, at least 4 times, or at least 5 times the thickness of the diaphragm. The higher stiffness of a corrugated diaphragm for small deflections enables the corrugated diaphragm (e.g., the diaphragm 202 of FIG. 2) to withstand the large pressure differential between the near-vacuum pressure in the cavity and the exterior pressure.

Without being bound by theory, it is believed that the relative stiffness of corrugated and non-corrugated diaphragms for small and large deflections is governed by the flexural and tensile rigidity of the diaphragms. Diaphragm bending occurs both radially and tangentially. For small deflections, tensile contributions to diaphragm bending can be neglected, and the stiffness of a diaphragm can be considered to depend only on flexural rigidity. The flexural rigidity in the radial direction depends on diaphragm thickness and corrugated and non-corrugated diaphragms have equal flexural rigidity in the radial direction. A corrugated diaphragm has a higher flexural rigidity in the tangential direction than does a non-corrugated diaphragm, making the corrugated diaphragm stiffer than the non-corrugated diaphragm at small deflections.

For larger deflections, the tensile stress due to diaphragm stretching contributes to diaphragm bending, and the stiffness of a diaphragm depends on both flexural and tensile rigidity. Accounting for both flexural and tensile rigidity means that the relative stiffness of corrugated and non-corrugated diaphragms for larger deflections can differ from the relative stiffness at small deflections. For instance, a corrugated diaphragm has a smaller tensile rigidity in the radial direction than does a non-corrugated diaphragm. With larger deflection, tensile stress increases, and the role of the smaller tensile rigidity of the corrugated diaphragm begins to dominate the pressure-deflection response of the diaphragm, until the stiffness of the corrugated diaphragm becomes smaller than the stiffness of the non-corrugated diaphragm.

Figure 4:
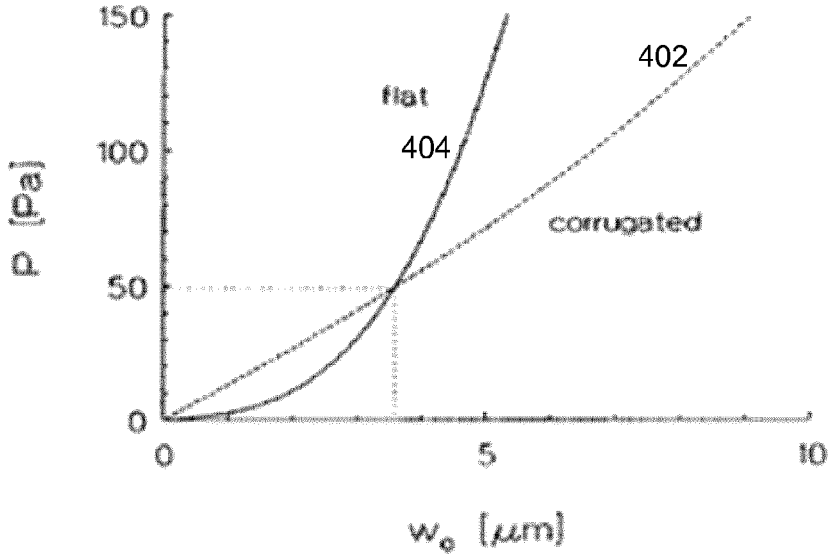
FIG. 4 is a plot of pressure-deflection curves for corrugated and non-corrugated diaphragms.

FIG. 4 shows example pressure-deflection curves for stress-free, circular diaphragms with corrugations (402) and without corrugations (404). As can be seen from FIG. 4, at small deflections, the corrugated diaphragm exhibits less deflection for a given applied pressure than does the non-corrugated diaphragm, meaning that the corrugated diaphragm is stiffer than the non-corrugated diaphragm. At a certain deflection (about 3.5 μm, in this example), the corrugated diaphragm becomes less stiff than the non-corrugated diaphragm.

As can also be seen from FIG. 4, a corrugated diaphragm exhibits a more linear pressure-deflection relationship than a non-corrugated diaphragm. This can also be seen from Equation (3), which shows that as the corrugation profile factor increases and the coefficients a and b increase and decrease, respectively, the linear component of the pressure-deflection relationship becomes more dominant. The linearity of the pressure-deflection relationship affects the sensitivity of the diaphragm, which impacts the performance of the microphone. Sensitivity S is the slope of the pressure-deflection curve. A diaphragm with a substantially linear pressure-deflection relationship, such as a corrugated diaphragm, has a consistent sensitivity across a wide range of applied pressures and thus exhibits a consistent pressure-deflection response across that wide range of applied pressures.

In the context of the low-noise microphone 200, the corrugated diaphragm 202, with a substantially linear pressure-deflection relationship, has a higher sensitivity to small applied pressures (e.g., low intensity sound) than a non-corrugated diaphragm. For instance, the corrugated diaphragm 202 can have a sensitivity sufficient to detect pressure fluctuations of less than about 100 kPa, e.g., less than about 10 kPa, less than about 1 kPa, less than about 100 Pa, less than about 10 Pa, or less than about 1 Pa. For instance, the corrugated diaphragm 202 can have a sensitivity sufficient to detect very low frequency pressure fluctuations, such as atmospheric pressure fluctuations.

Figure 5:
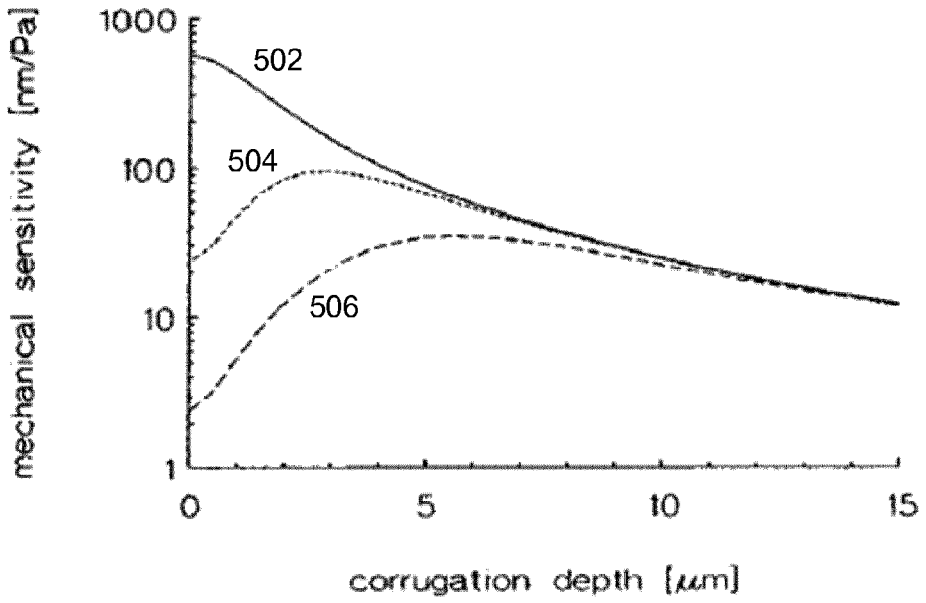
FIG. 5 is a plot of mechanical sensitivity versus corrugation geometry.

FIG. 5 shows the effect of stress on diaphragm sensitivity for a diaphragm without stress (502), with a stress of $10^7$ $N/m^2$ (504), and with a stress of $10^8$ $N/m^2$ (506). As can be seen, for certain corrugation geometries (e.g., for certain corrugation depths), a diaphragm with less stress is more sensitive. The reduction of residual stress through the presence of corrugations thus also contributes to the enhanced sensitivity of a corrugated diaphragm. For certain corrugation geometries (e.g., for larger corrugation depths), the mechanical sensitivity of the diaphragm is not impacted significantly by the stress in the diaphragm. This indicates that the role of the corrugations in reducing residual stress in the diaphragm does not adversely affect the sensitivity of the diaphragm.

Figure 6:
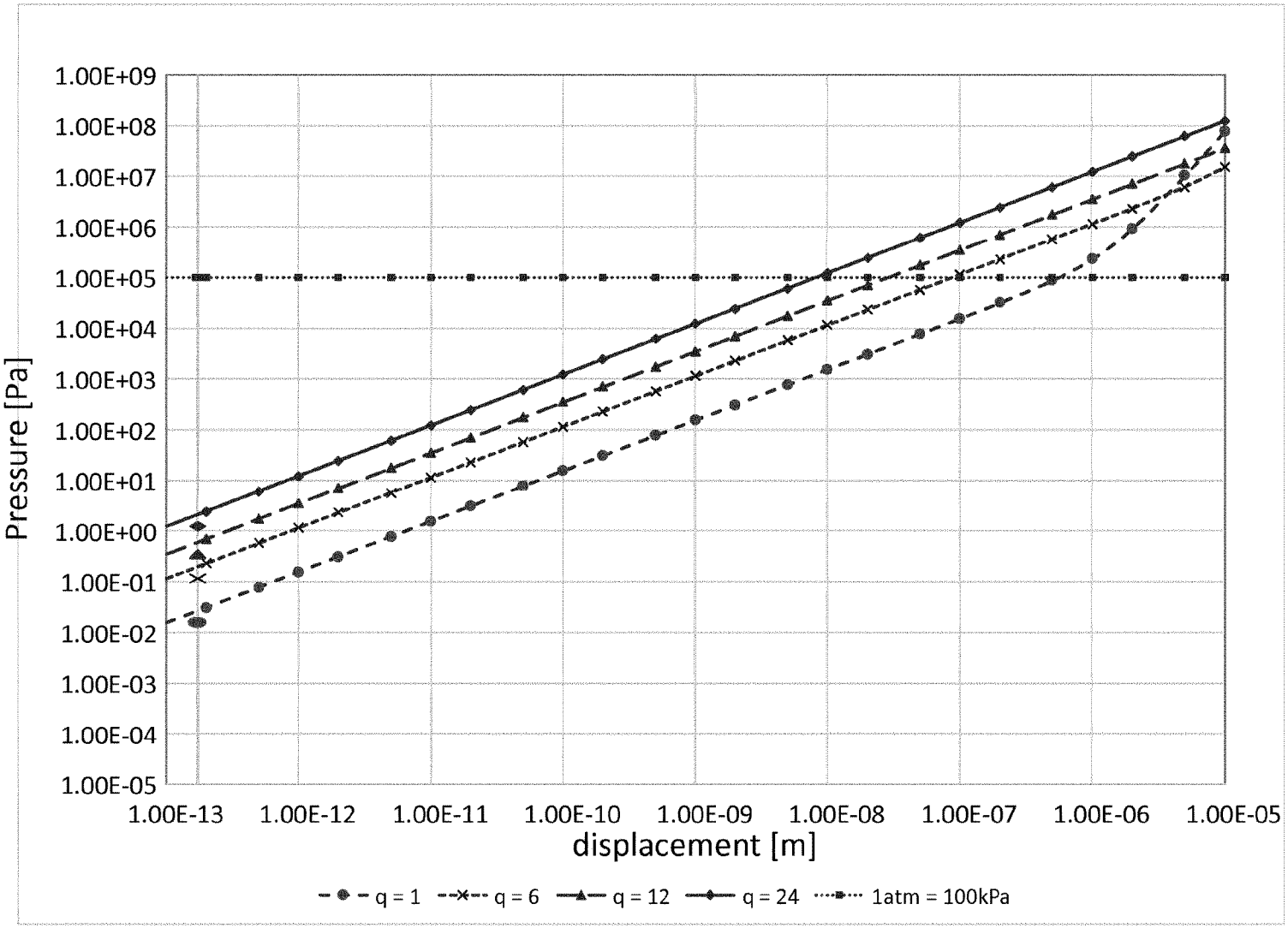
FIG. 6 is a plot of pressure-deflection curves for corrugated tungsten diaphragms.

FIG. 6 shows pressure-deflection curves for tungsten diaphragms having various corrugation profile factors. The tungsten diaphragm has a residual stress of 1 GPa, a thickness of 1 μm, a radius of 0.125 mm, and a stress attenuation coefficient η of 0.01. As can be seen from FIG. 6, the pressure-deflection relationship is substantially linear across a wide range of q values at and around atmospheric pressure, which is approximately the pressure differential between the pressure in the cavity and the exterior pressure. This linearity enables the microphone to have a consistent, high sensitivity in the relevant pressure range.

The sensitivity of a corrugated diaphragm can also be improved by designing the diaphragm to have a resonance frequency in the audio range, e.g., between about 20 Hz and about 20 KHz. When the resonance frequency of a corrugated diaphragm falls within the audio range, the deflection of the diaphragm varies significantly in response to slight differences in applied pressure. This means that a corrugated diaphragm 202 having a resonance frequency in the audio range can be highly sensitive to small sound variations.

Figure 7:
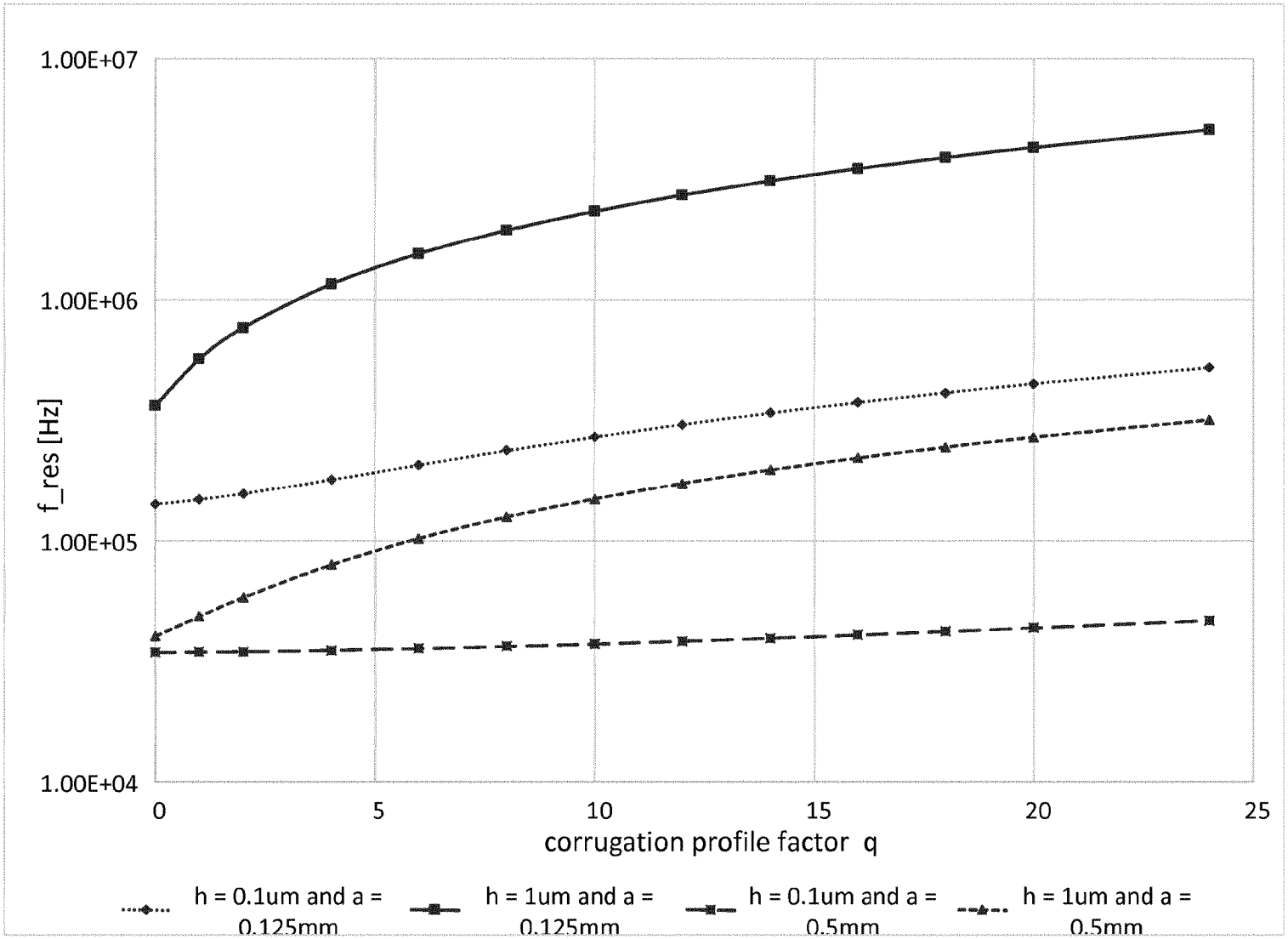
FIG. 7 is a plot of resonance frequency versus corrugation profile factor.

FIG. 7 shows plots of resonance frequency versus corrugation profile factor q for various diaphragm geometries (specifically, for various heights h and radii a). As can be seen, both the corrugation profile and the geometry of the diaphragm affect the resonance frequency of the diaphragm.

FIG. 8 shows an example of a low-noise optical microphone 800. Although we describe FIG. 8 in the context of microphone, a similar structure can also be used for other types of capacitive sensors, such as other types of audio sensors, pressure sensors, transducers (e.g., a CMUT), or other sensors.

The low-noise microphone 800 includes a diaphragm 802 separated from a substrate 804 by side walls 806. The diaphragm 802 can be a membrane or a plate. A back side 824 of the diaphragm 802 can be formed of a reflective material, such as a metal. The diaphragm 802 can be formed of a conductive material or a non-conductive material, such as a conductive metal, a non-conductive polymer, conductive polycrystalline silicon, non-conductive silicon nitride or silicon oxide, or another conductive or non-conductive material.

The diaphragm 802, substrate 804, and side walls 806 are solid materials with no through-thickness holes that define an interior cavity 812 that is isolated from an exterior 814 of the microphone 800. For instance, the cavity 812 can be hermetically sealed. As discussed above, a sealed cavity with no through-thickness holes to the exterior 814 of the microphone 800 enables a high signal-to-noise ratio can be achieved and prevents entry of contaminants into the cavity 812, thereby improving the reliability of the microphone 800.

The pressure in the cavity 812 can be lower than the exterior pressure, e.g., the cavity pressure can be at near-vacuum. The diaphragm 802 can be a thin diaphragm, e.g., as discussed above for the diaphragm 202. The diaphragm 802 can be a corrugated diaphragm including one or more corrugations 816, e.g., similar to those described above for the diaphragm 202. In some examples, a bias voltage Vbias can be applied between the diaphragm 802 and another electrode (not shown) by a voltage source 818 to help the diaphragm 802 sustain the large pressure differential between the cavity pressure and the exterior pressure. The diaphragm 802 can be designed to have a resonance frequency in the audio range.

Sound detection by the microphone 802 is based on optical detection of the deflection of the diaphragm 802 responsive to a sound wave 808 impinging on the diaphragm 802. A light source 820, such as a laser, and one or more photodetectors 822 are disposed on the surface of the substrate 804 or formed integrally with the substrate 804. For instance, the substrate 804 can be an integrated circuit and the light source 820 and photodetectors 822 can be components of the integrated circuit. The light source 820 is positioned to illuminate the reflective back side 824 of the diaphragm 802, and the photodetectors 822 are positioned to receive light reflected back from the diaphragm 802.

Acoustic pressure from a sound wave 808 incident on the diaphragm 802 causes the diaphragm 802 to deflect toward the substrate 804. The deflection of the diaphragm 802 changes the optical path length between the light source 820 and the back side 824 of the diaphragm 802 and between the back side 824 of the diaphragm 802 and the photodetectors 822. The deflection of the diaphragm 802 can also change the angle of the light reflected back toward the photodetectors 822. These changes in optical path length and angle can result in a change in a voltage signal $V_{out}$ output from the photodetectors 822. For instance, the photodetectors 822 can include two photodetectors that function together as an interferometer. In this way, the output voltage signal $V_{out}$ represents the sound wave incident on the diaphragm 802. In some examples, the corrugations on the diaphragm can be used as a diffraction grating for the reflected light to enhance the sensitivity of the optical detection.

In some examples, multiple small sensors, such as sensors (e.g., microphones) having small diameter diaphragms, can be used in parallel to provide a desired degree of sensitivity. For instance, multiple small diaphragms can be fabricated as part of a single integrated circuit.

In some examples, the sensors described here, such as the low-noise microphones 200, 800, can be fabricated using complementary metal oxide semiconductor (CMOS) processing. CMOS processing is well established and relatively inexpensive, and the use of CMOS processing can keep down fabrication costs for the sensors. In CMOS fabrication, the corrugations in the diaphragm can be etched, which allows for a high degree of control over the corrugation profile and accordingly over the stiffness and sensitivity of the diaphragm.

FIGS. 9A-9D are cross sectional views of a CMOS fabrication process for a capacitive sensor such as the microphone 200 of FIG. 2. An optical sensor such as the microphone 800 of FIG. 8 can be fabricated using a similar process.

Figure 9A:
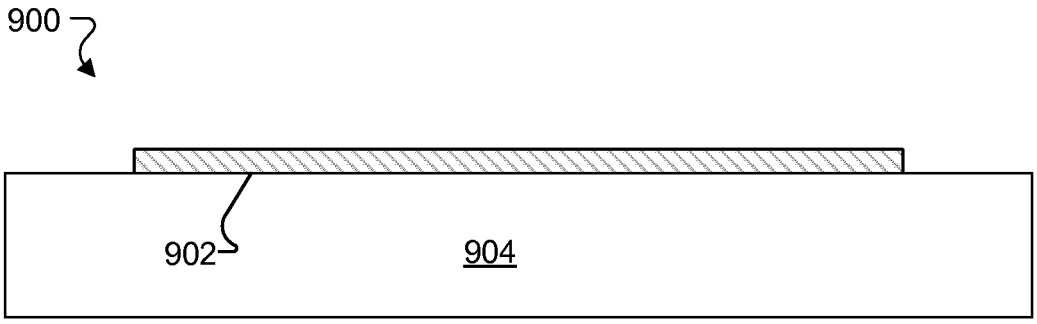
FIGS. 9A-9D are cross sections of a sensor fabrication process.
Figure 9B:
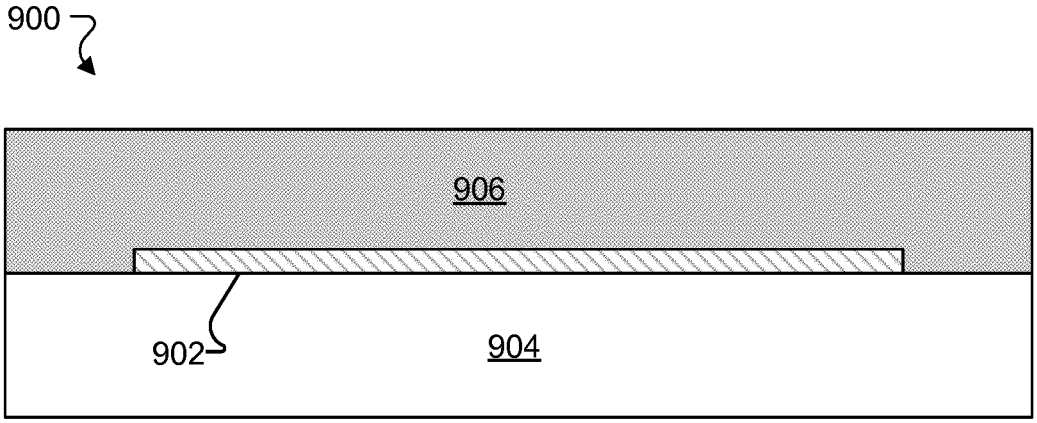

Referring first to FIG. 9A, in the formation of an integrated circuit sensor 900, an electrode 902 is formed on a top surface of a substrate 904, such as a silicon substrate, using CMOS patterning and deposition techniques. Referring to FIG. 9B, an insulator layer 906, such as silicon oxide, is deposited onto the top surface of the substrate 904. In some examples, one or more layers of metal interconnects can be formed using CMOS patterning and deposition techniques.

Figure 9C:
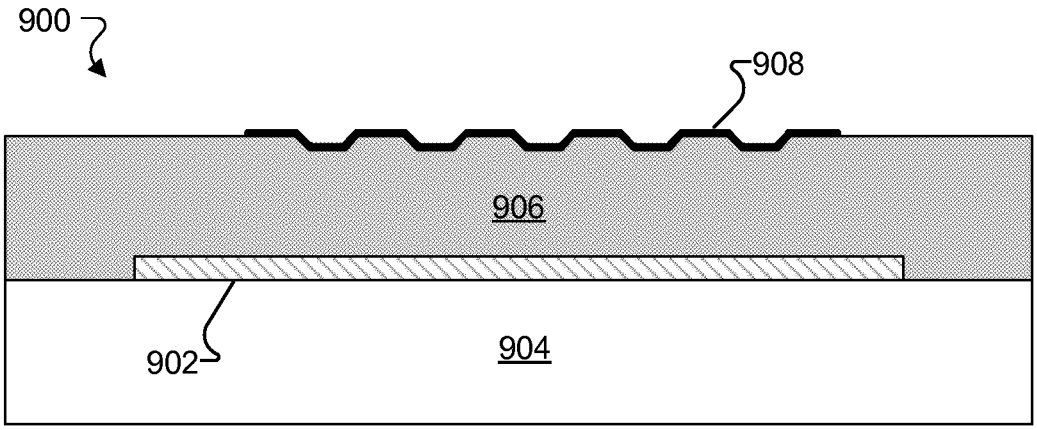

Referring to FIG. 9C, a patterned metal layer 908 is formed on the top surface of the insulator layer 906. For instance, the insulator layer 16 is lithographically patterned and etched, and the metal layer 908 is deposited onto the patterned insulator layer 906. The metal layer 908 will become the diaphragm of the sensor, and the patterning of the metal layer corresponds to the corrugations of the diaphragm.

Figure 9D:
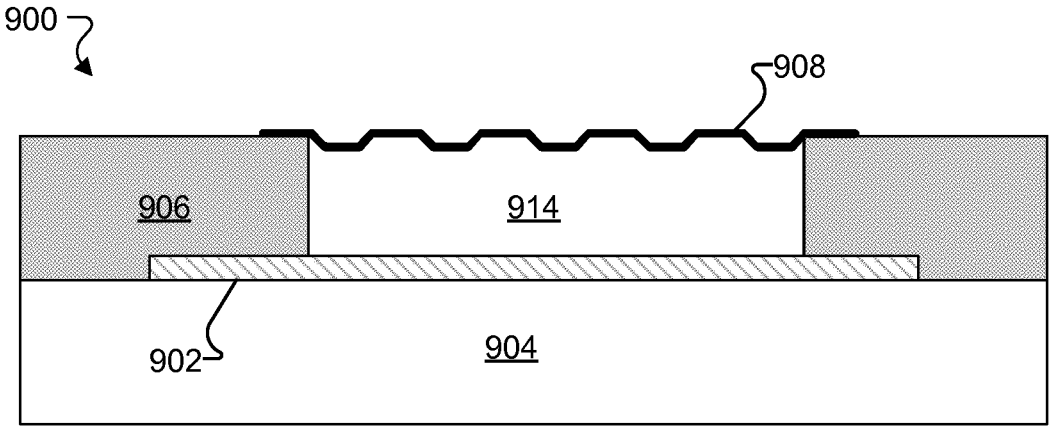

Referring to FIG. 9D, a portion of the insulator layer 906 between the metal layer 908 and the electrode 902 is removed, thereby forming a cavity 914 separating a diaphragm 912 from the electrode 902. For instance, the portion of the insulator layer 906 can be removed by etching, such as a deep reactive ion etching (DRIE) process. The electrode 902 and diaphragm 912 can be coupled to circuitry, such as metal interconnects in the integrated circuit or external circuitry, that enables application of a bias between the electrode 902 and the diaphragm 912 or the generation of a voltage signal based on capacitance changes between the electrode 902 and the diaphragm 912.

Figure 10A:
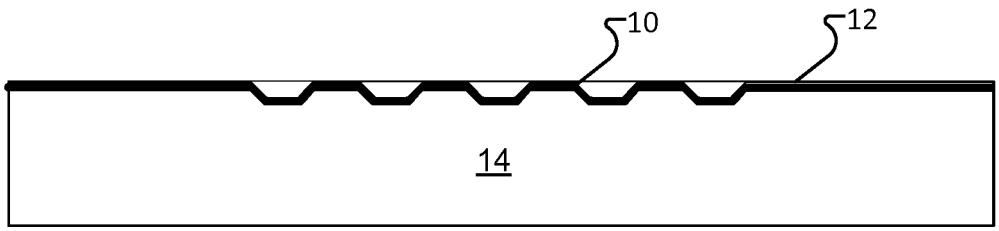
FIGS. 10A-10C are cross sections of a corrugated diaphragm fabrication process.
Figure 10B:
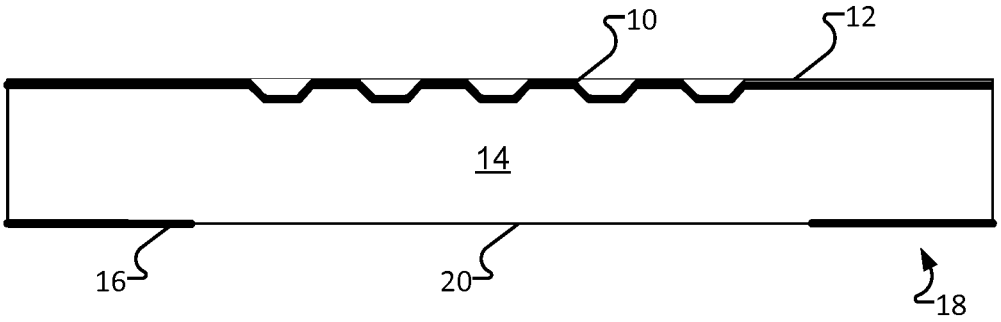
Figure 10C:
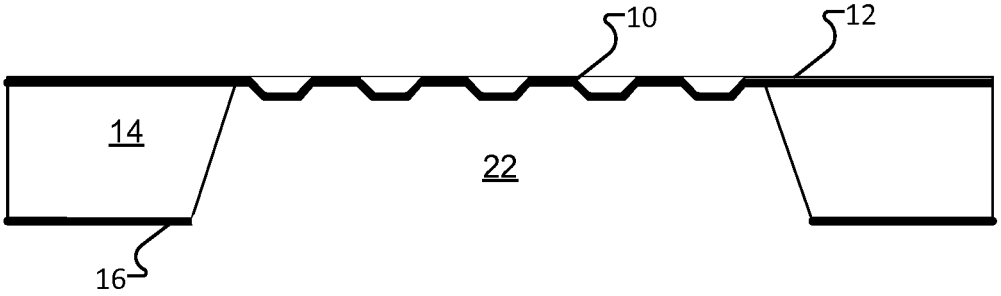

In some examples, the sensors described here, such as the low-noise microphones 200, 800, can be fabricated using microelectromechanical systems (MEMS) processing techniques. Referring to FIG. 10A, in an example MEMS process, corrugations 10 can be etched into a thin film 12 formed on a substrate 14 using a reactive ion etching (RIE) process. Referring to FIG. 10B, an etch stop material 16, such as silicon nitride, can be deposited onto the corrugated thin film 12 (not shown) and onto a back side 18 of the substrate 14. For instance, the etch stop material can be deposited by a chemical vapor deposition (CVD) process, such as a low pressure CVD process. A window 20 is etched in the back side etch stop layer 16, e.g., using RIE. Referring to FIG. 10C, the substrate 14 is etched from the back side 18 in an anisotropic etch process, e.g., using a potassium hydroxide solution, with the back side etch stop layer 16*b* serving as an etch mask. The substrate etching forms a cavity 22 in the substrate 14. In some examples, the sensors described here can be fabricated using a combination of CMOS and MEMS fabrication techniques.

A number of embodiments have been described. Nevertheless, it will be understood that various modifications may be made without departing from the spirit and scope of the invention. For example, some of the steps described above may be order independent, and thus can be performed in an order different from that described.

Other implementations are also within the scope of the following claims.

What is claimed is:

1. A sensor comprising:

a substrate; and a corrugated diaphragm offset from the substrate, the corrugated diaphragm being configured to deflect responsive to a sound wave impinging on the corrugated diaphragm, the corrugated diaphragm having a corrugation profile factor of between 1 and 24; and in which a cavity is defined between the corrugated diaphragm and the substrate, the corrugated diaphragm forming a top surface of the cavity and the substrate forming a bottom surface of the cavity, in which a pressure in the cavity is lower than a pressure outside of the cavity.

2. The sensor of claim 1, in which the corrugated diaphragm comprises one or more of:

a membrane;

a plate; and/or a conductive diaphragm.

3. The sensor of claim 1, comprising circuitry configured to enable generation of an electrical signal based on the deflection of the corrugated diaphragm.

4. The sensor of claim 1, in which the corrugated diaphragm comprises a conductive diaphragm and the substrate comprises an electrode.

5. The sensor of claim 4, comprising circuitry configured to enable generation of an electrical signal based on a voltage between the corrugated diaphragm and the electrode of the substrate.

6. The sensor of claim 5, comprising a voltage source configured to apply a bias voltage between the diaphragm and the electrode of the substrate.

7. The sensor of claim 1, in which a surface of the corrugated diaphragm facing the substrate is reflective.

8. The sensor of claim 7, in which the substrate comprises:

a light source positioned to illuminate the reflective surface of the corrugated diaphragm; and a detector configured to generate an electrical signal based on light reflected from the reflective surface of the corrugated diaphragm.

9. The sensor of claim 1, in which the cavity is hermetically sealed.

10. The sensor of claim 1, in which the cavity is at near-vacuum pressure.

11. The sensor of claim 1, in which the corrugated diaphragm exhibits a substantially linear relationship between applied pressure and deflection.

12. The sensor of claim 1, in which a resonant frequency of the corrugated diaphragm is in an audio frequency range.

13. The sensor of claim 1, in which the corrugated diaphragm comprises multiple concentric corrugations.

14. The sensor of claim 1, in which the corrugated diaphragm comprises a corrugation centered around a center of the membrane.

15. The sensor of claim 1, in which the sensor comprises one or more of:

a microphone;

a transducer; and/or a pressure sensor.

16. A method comprising:

deflecting a corrugated diaphragm of a sensor into a cavity responsive to a sound wave impinging on the corrugated diaphragm, the corrugated diaphragm having a corrugation profile factor of between 1 and 24, in which a top surface of the cavity is defined by the corrugated diaphragm and a bottom surface of the cavity is defined by a substrate of the sensor, and in which a pressure in the cavity is lower than a pressure outside the cavity; and generating an electrical signal based on the deflection of the corrugated diaphragm.

17. A method for making a sensor, the method comprising:

forming a corrugated diaphragm offset from a substrate, a thickness of the corrugated diaphragm being sufficient for the corrugated diaphragm to deflect responsive to a sound wave impinging on the corrugated diaphragm, the corrugated diaphragm having a corrugation profile factor of between 1 and 24; and defining a cavity between the corrugated diaphragm and the substrate, the corrugated diaphragm forming a top surface of the cavity and the substrate forming a bottom surface of the cavity, in which the cavity is hermetically sealed.

18. The method of claim 17, in which forming a corrugated diaphragm comprises forming the corrugated diaphragm by a complementary metal-oxide-semiconductor (CMOS) fabrication process and/or microelectromechanical systems (MEMS) fabrication process.

19. The method of claim 18, in which defining a cavity between the corrugated diaphragm and the substrate comprises removing an insulating layer disposed between the corrugated diaphragm and the substrate by an etching process.

20. A sensor comprising:

a substrate; and a corrugated diaphragm offset from the substrate, the corrugated diaphragm being configured to deflect responsive to a sound wave impinging on the corrugated diaphragm, the corrugated diaphragm exhibiting a substantially linear relationship between applied pressure and deflection; and in which a cavity is defined between the corrugated diaphragm and the substrate, the corrugated diaphragm forming a top surface of the cavity and the substrate forming a bottom surface of the cavity, in which a pressure in the cavity is lower than a pressure outside of the cavity.

21. A sensor comprising:

a substrate comprising an electrode;

a corrugated diaphragm offset from the substrate, the corrugated diaphragm being configured to deflect responsive to a sound wave impinging on the corrugated diaphragm, corrugated diaphragm comprising a conductive diaphragm; and circuitry configured to enable generation of an electrical signal based on a voltage between the corrugated diaphragm and the electrode of the substrate; and a voltage source configured to apply a bias voltage between the diaphragm and the electrode of the substrate, in which a cavity is defined between the corrugated diaphragm and the substrate, the corrugated diaphragm forming a top surface of the cavity and the substrate forming a bottom surface of the cavity, in which a pressure in the cavity is lower than a pressure outside of the cavity.

22. A sensor comprising:

a substrate; and a corrugated diaphragm offset from the substrate, the corrugated diaphragm being configured to deflect responsive to a sound wave impinging on the corrugated diaphragm, a resonant frequency of the corrugated diaphragm being in an audio frequency range, in which a cavity is defined between the corrugated diaphragm and the substrate, the corrugated diaphragm forming a top surface of the cavity and the substrate forming a bottom surface of the cavity, in which a pressure in the cavity is lower than a pressure outside of the cavity.

* * * * *